United States Patent [19]

Meinander

[11] Patent Number: 4,492,611

[45] Date of Patent: Jan. 8, 1985

[54] EXTENDED NIP PRESS WITH MOVABLE SEALING STRIPS

[75] Inventor: Paul O. Meinander, Osnabrück, Fed. Rep. of Germany

[73] Assignee: A. Ahlstrom Osakeyhtio, Noormarkku, Finland

[21] Appl. No.: 510,877

[22] Filed: Jul. 5, 1983

[30] Foreign Application Priority Data

Jul. 13, 1982 [FI] Finland ..... 822482

[51] Int. Cl.[3] ..... D21F 3/06

[52] U.S. Cl. ..... 162/358; 162/360.1; 100/151

[58] Field of Search ..... 162/358, 360, 361, 371, 162/205; 100/151

[56] References Cited

U.S. PATENT DOCUMENTS

| | | | |
|---|---|---|---|
| 2,900,024 | 8/1954 | Holcroft | 162/371 |
| 3,840,429 | 10/1974 | Busker et al. | 162/358 |
| 3,970,515 | 7/1976 | Busker | 162/360 |
| 3,974,026 | 8/1976 | Enson | 162/358 |

*Primary Examiner*—Steve Alvo

*Attorney, Agent, or Firm*—Bucknam and Archer

[57] ABSTRACT

A press for removing liquid from a moving material web comprising two endless liquid impervious belts which form an extended press nip. At least one liquid pervious and/or absorbing belt passes through the nip together with the material web. The inner surface of one of the liquid impervious belts together with the pressure member forms a pressure compartment for exerting pressure onto the material web along its whole width in the nip with movable sealing strips at each end of the extended nip. The inner surface of the other liquid impervious belt slides along the slide surface of the support member.

3 Claims, 4 Drawing Figures

EXTENDED NIP PRESS WITH MOVABLE SEALING STRIPS

The present invention relates to a press for removing liquid from a web of paper, cellulose or other material where the travelling web is subjected to pressing force for a longer time than in a conventional roll press.

The object of the invention is to provide an extended nip press which is simpler and cheaper than the earlier constructions.

Various extended nip presses have been disclosed by e.g. U.S. Pat. Nos. 3,970,515, 3,808,096, 3,783,097 and 3,748, 225.

The extended nip press according to the invention comprises two endless belts which are impervious to liquid and form an extended nip press; at least one belt which is pervious to liquid and/or liquid absorbing which together with the material web travels through the nip; a pressure member which together with the inner surface of one of the liquid impervious belts forms a pressure compartment/compartments for exerting pressure onto the material web along its whole width in the nip, and a supporting member which contacts the inner surface of the other liquid impervious belt and is provided with a slide surface.

Compared with the extended nip presses disclosed by the patent specifications mentioned above the construction according to the inventions provides the following advantages:

- A beam acts as the pressing element which is relatively easy to design sturdy enough to avoid detrimental deflection.
- As the construction allows the pressing beams to be mounted semi-stationary in relation to each other and their distance from each other can be adjusted, the sealing requirement is not as high as in constructions where the pressing element must follow the variations of the web thickness.
- The sealing strips of the pressure members are the only mechanically moving elements in the press.
- Due to its simple structure the press maybe easily opened for change of sealing strips. Thus the sealings may be made of a relatively wearing material which makes it easier to find a suitable elastic material.
- As the web can be made to travel through the nip e.g. rectilinearly it is possible to avoid subjecting the web to unnecessary bends which may decrease its strength.
- Since the press zone can easily be devided into smaller zones and their pressures separately adjusted, optimal pressing can be obtained.
- Since the press can, due to its mechanical construction, be built very long, the effect of several presses is obtainable by this press and thus the press section can be decisively simplified.
- There are only few wearing parts and they are inexpensive.
- As the beams are connected to each other, i.e. the power system is internal, the other construction of the machine can be made fairly slight.
- Since the beams need only be adjusted in relation to each other, they can easily be detached for change of felt or press belt. Further more, cantilevering of the beams is very easy to arrange.

Figure 1:
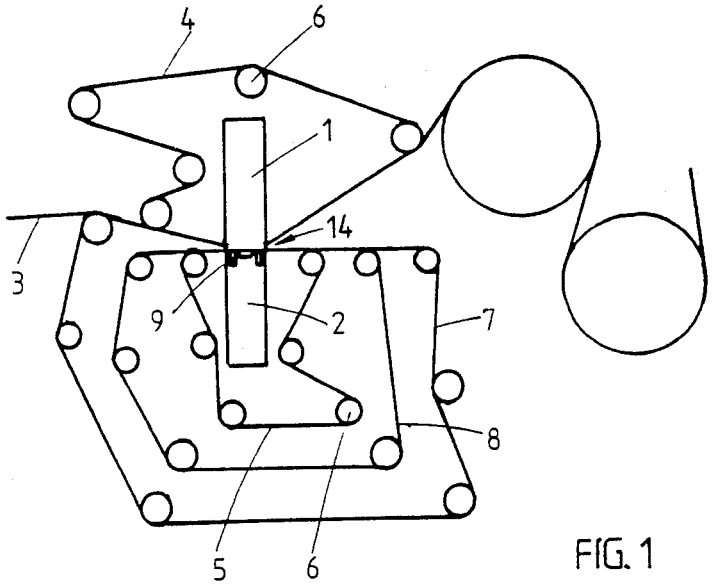
Figure 2:
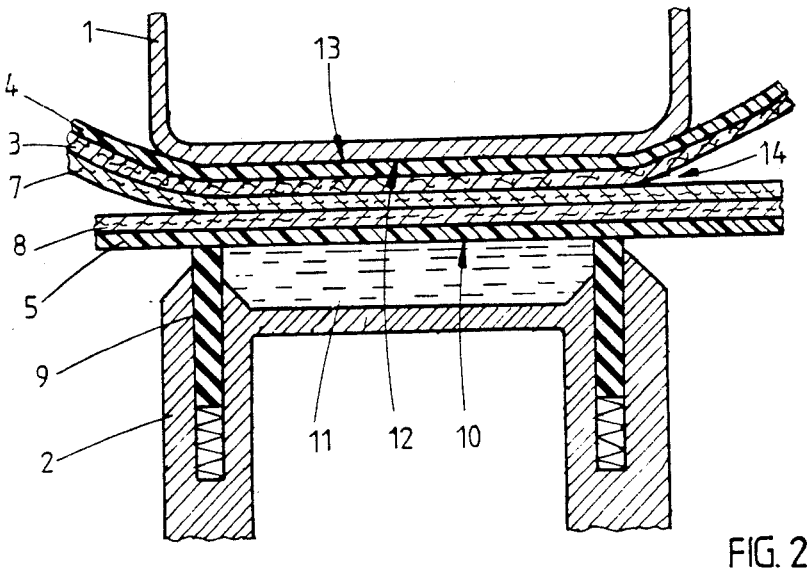
Figure 3:
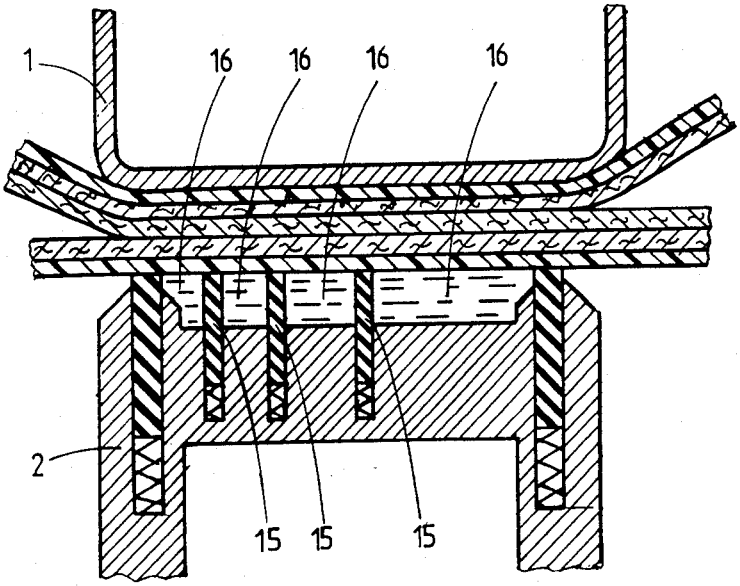
Figure 4:
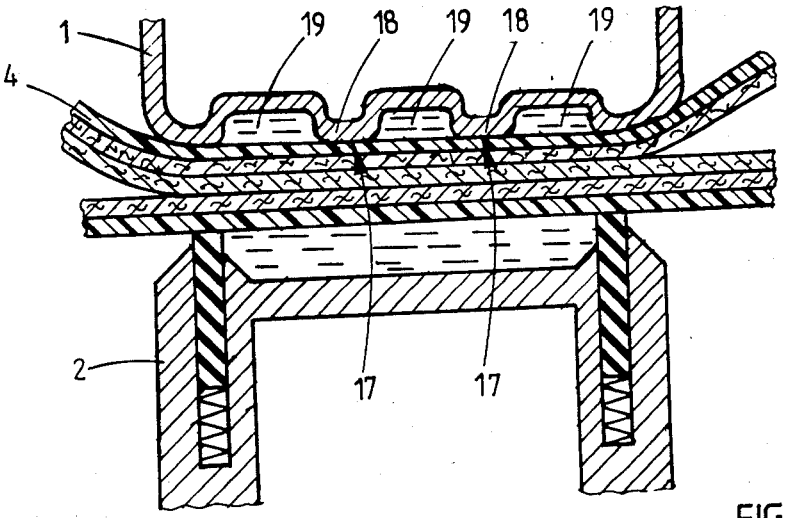

The invention is described below in more detail with reference to the drawings attached where FIG. 1 is a schematic cross section of an embodiment of the apparatus according to the invention, FIG. 2 is a schematic cross section of the press nip area of FIG. 1 in a larger scale, FIG. 3 is a schematic cross section of another embodiment of the apparatus according to the invention, FIG. 4 is a schematic cross section of yet another embodiment of the apparatus according to the invention.

The press illustrated in FIGS. 1 and 2 consists of two beams 1 and 2 mounted semi-stationary in relation to each other. The distance of the beams from each other can be adjusted and they are disposed in a transverse position in relation to the travelling direction of a paper web 3. The upper beam 1 acts as a supporting member of an endless water impervious belt 4, and the lower beam 2 as a pressing member of another endless water impervious belt 5, directing the pressing force to belt 5 whereby the belts together form a press nip. Rolls 6 guide the web to run through the nip. The paper web 3 and a water pervious and/or absorbing belt 7, e.g. press felt, and possibly yet another water pervious belt 8 provided to increase the dewatering capacity, e.g. a fabric wire, are guided to travel through the nip.

In order to create pressure in the nip the beam 2 is provided with movable, preferably elastic, sealing strips 9, which are in sealing contact with the inner surface 10 of the endless belt 5 whereby a closed pressure chamber 11 is formed which is supplied by liquid, e.g. water or other appropriate pressurized medium. Beam 1 has a substantially plane slide surface 12 along which the inner surface 13 of the endless belt 4 travels. Lubricant may by known methods be supplied between the belt and the slide surface e.g. on the front side of the beam.

Beams 1 and 2 are positioned in relation to each other so that the sealing strips 9 are able to compensate both the deflection of the beam and the variations in the thickness of the material web, belts and the fabric-wire.

By forming the slide surface 12 optimal geometry can be obtained for the nip (e.g. linear).

By designing appropriately the outlet side 14 of the slide surface 12 the web is made to quickly detach itself from the felt 7, whereby rewetting of the web is prevented.

The length of the nip is chosen for optimal pressing whereby the length is a function of speed and dewatering. The presumptive optimal length varies from 10 cm to 1 m.

In the embodiment illustrated in FIG. 3 the beam is provided with several transverse sealing strips 15 in such a way that a plurality of subsequent pressure compartments 16 are formed which can be provided with different pressures. In this manner e.g. a gradually increasing pressure can be created in the nip.

In the embodiment illustrated in FIG. 4 several transverse supporting strips 18 provided with slide surfaces 17 have been formed in the beam forming pressurized compartments 19 between them. In this way an efficient lubrication and good guiding has been provided for the moving belt 4.

We claim:

1. A press for removing liquid from a moving material web, comprising two endless liquid impervious belts forming an extended press nip;

at least one liquid pervious belt which together with said material web travels through the nip;

a first beam provided with movable sealing strips at each end of the extended nip which together with the inner surface of one of said liquid impervious belts forms at least one pressure compartment for exerting pressure onto said material web in the nip along its entire width, wherein the movable sealing strips compensate for the deflection of the beams and the thickness of the moving material web;

a seond beam which is in contact with the inner surface of the other of the liquid impervious belts and is provided with a slide surface, said slide surface being essentially plane; and wherein the distance between said first beam and said second beam is adjustable.

2. The press according to claim 1 wherein a plurality of pressure compartments is formed by said first beam and the inner surface of one of said liquid impervious belts and the pressure gradually increases in the travelling direction of the material web.

3. The press according to claim 1 wherein said second beam is provided with a plurality of transverse support strips provided with slide surfaces.

* * * * *